United States Patent [19]

Thomas

[11] 4,009,777

[45] Mar. 1, 1977

[54] CONTACT LENS HOLDER

[75] Inventor: Michael D. Thomas, Elmhurst, Ill.

[73] Assignee: Ryder International Corporation, Schaumburg, Ill.

[22] Filed: Dec. 29, 1975

[21] Appl. No.: 645,280

[52] U.S. Cl. ..... 206/5.1; 134/137

[51] Int. Cl.[2] ..... A45C 11/00; B65D 85/54; B08B 3/04

[58] Field of Search ..... 206/5.1; 220/23, 17; 134/137, 158

[56] References Cited

UNITED STATES PATENTS

| | | | |
|---|---|---|---|
| 2,721,567 | 10/1955 | Tierney | 134/158 |
| 3,007,566 | 11/1961 | Morris | 206/5.1 |
| 3,643,672 | 2/1972 | Brown | 206/5.1 |
| 3,661,248 | 5/1972 | Isen et al. | 134/137 |
| 3,770,113 | 11/1973 | Thomas | 206/5.1 |

*Primary Examiner*—William T. Dixson, Jr.
*Attorney, Agent, or Firm*—Olson, Trexler, Wolters, Bushnell & Fosse, Ltd.

[57] ABSTRACT

A holder for contact lenses is provided. To encourage lense contact with a cleaning solution, the holder comprises a pair of masts extending from a capsule cap toward free mast ends. Two open topped baskets are pivotally attached to the mast free ends. Each basket includes a centrally located dome surface to support a center portion of one lens surface, an open web extending away from the dome and defining apertures to permit free passage of the sterilizing solution to and from the lens, and a rim extending from the web toward the mast to support an edge portion of the lens with substantially point contact.

11 Claims, 3 Drawing Figures

CONTACT LENS HOLDER

BACKGROUND OF THE INVENTION

This invention relates generally to a holder or retainer structure for contact lenses or the like, and more particularly concerns a contact lens holder which promotes and encourages maximum contact of the lenses with a cleaning solution in a container or capsule.

Corneal contact lenses have offered a popular method of human sight correction for a number of years. Recent technical developments have resulted in commercially offered contact lenses made of a soft or pliable plastic material. At least some of these soft lenses, as they are termed, are hydrophilic in nature, that is to say, they have the ability to absorb water. This characteristic permits the lenses to be optically formed or machined in rather hard state, and softened due to the absorption of water. The lens as such are porous, and will support the growth of, and harbor, germs and bacteria. Accordingly, soft contact lens users, and some other lens users as well, must sterilize their lenses daily or at other periodic intervals to destroy the bacteria or germs which may be absorbed by the lenses or retained on the lens surfaces. If this sterilization is for some reason ineffective, the remaining contaminents may cause eye inflamation or damage to the cornea of the lens user.

Popular methods of sterilization require that the lenses be immersed in a saline or other liquid cleaner solution, and then boiled to insure lens asepticity. At least some lens sterilizing methods involve enclosing the lenses in a small capsule which is partially filled with the saline cleaning solution. The enclosed capsule is then suspended in boiling water or is otherwise heated to bring the cleaning solution to a sterilizing temperature.

A number of capsule containers and accompanying devices for suspending the lenses within the containers have been offered. For example, see U.S. Pat. No. 3,770,113. At least some of these are complicated in construction and are accordingly expensive, while others do not adequately secure the lenses from loss. Some lens holders inhibit complete lens-cleaning solution contact and flow of the solution to and from the lens. Use of these structures accordingly increases the possibility that incomplete lens sterilization will be obtained.

It is thus a general object of the present invention to provide a structure which will securely retain a pair of contact lenses in a cleaning solution, and which will maximize solution contact with those lenses. Another object is to provide such a structure which encourages solution flow to and from the entire lens. Conversely, an object is to provide such a structure in which lens-lens support structure contact is minimized, yet which will securely retain the lenses as desired.

Yet another object is to provide such a structure which minimizes the difficulty of placing the lenses in the structure for storage or sterilization, and correspondingly minimizes the difficulty of removing the lenses from the structure when lens use is desired.

A further object is to provide a structure of this type which is adapted for use with a small capsule containing the lens sterilizing or cleaning solution. An ancillary object is to provide a solution-tight, leak-free unit especially attractive to ordinary lens users.

Other objects and advantages of the invention will become apparent upon reading the following detailed description and upon reference to the drawings. Throughout the drawings, like reference numerals refer to like parts.

DETAILED DESCRIPTION

While the invention will be described in connection with a preferred embodiment, it will be understood that it is not intended to limit the invention to this embodiment. On the contrary, it is intended to cover all alternatives, modifications and equivalents included within the spirit and scope of the invention, as defined by the claims appended hereinafter.

DESCRIPTION OF THE ILLUSTRATED EMBODIMENT

Figure 1:
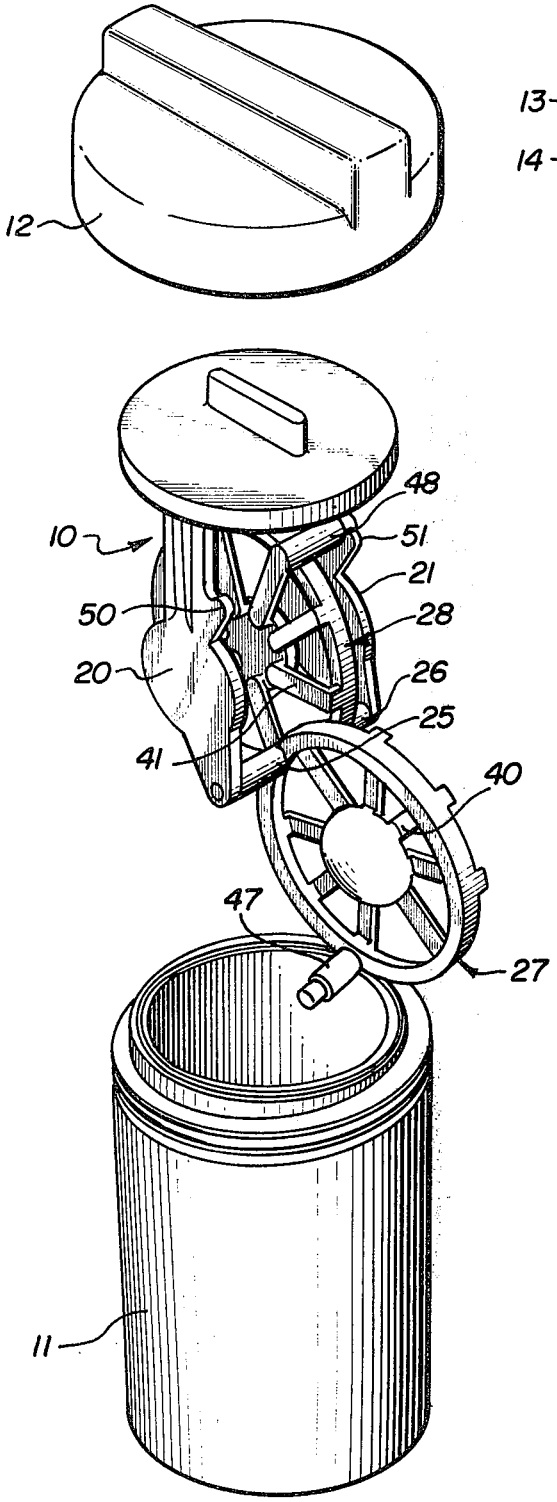
FIG. 1 is an exploded view showing the lens-securing and retaining structure of the present invention and an associated capsule and cap.
Figure 2:
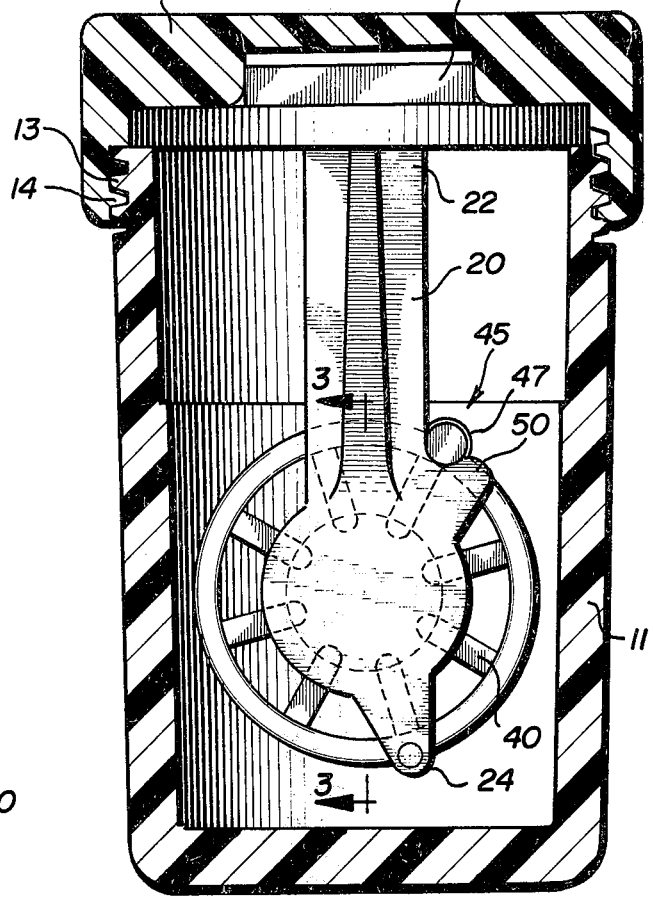
FIG. 2 is a sectional view showing the lens support structure and associated capsule as it appears when the support structure is secured within the capsule.

Turning first to FIGS. 1 and 2, there is shown the novel lens-securing and retaining structure 10 as it appears in association with a capsule 11 and overlying lid 12. Mating capsule threads 13 and lid threads 14 permit the lid 12 to be screwed onto the capsule 11 with a liquid-tight leak-free fit. If desired, the lid can be provided with gas venting structure (not shown) to relieve pressure within the capsule 10 which can develop as the capsule is heated, solution boiling begins, and sterilizing occurs.

Figure 3:
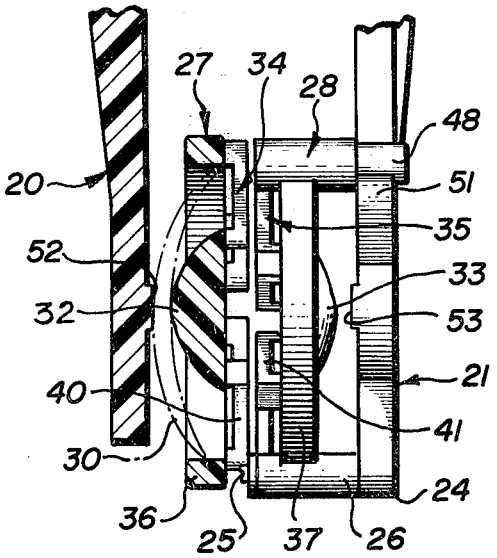
FIG. 3 is a view taken substantially in the plane of line 3—3 in FIG. 2 and showing, in partial section, further details of the lens retaining structure.

The lens retaining structure 10 includes two elongated masts 20 and 21 extending from cap ends 22 which are secured to a cap 23, toward and which terminate in free mast ends 24. At each mast free end 24, pivot structures 25 and 26 secure baskets 27 and 28 to the respective masts 20 and 21. As can be envisioned, these pivot structures 25 and 26 are oriented to cause each associated basket 27 and 28 to pivot in a plane parallel to the direction of a mast elongation into and out of the illustrated underlying relationships with the respective masts. When a basket 27 or 28 underlies its associated mast 20 or 21, a contact lens 30 can be retained between the basket and mast, as especially shown in FIG. 3.

In accordance with the invention, only minimal basket-lens contact and mast-lens contact is provided to encourage lens-cleaning solution contact, yet the lens 30 is securely retained between the basket and associated mast. To this end, each basket 27 or 28 is provided, in its center, with a dome 32 or 33. Extending from this central dome is a web 34 or 35. Each web terminates in a rim 36 or 37 of a size and shape adapted to contact a lens edge as illustrated. To further encourage lens-cleaning solution contact, and solution flow, these webs 34 and 35 may comprise a number of radially extending spokes 40 and 41 adapted to overlie one another when the baskets are carried within their underlying positions as illustrated in FIGS. 1 and 2.

A locking device 45 is provided to hold each basket 27 and 28 in its mast-underlying, lens-retaining position as illustrated in FIG. 2. Here, this locking device 45 includes fingers 47 and 48 protruding from the rim of each associated basket 27 and 28. These fingers 47 and 48 are located to engage detents 50 and 51 formed on the associated masts 20 and 21.

In use, each basket is pivoted from its closed, mast-underlying positions to an open position as illustrated for one basket 28 in FIG. 1. In this position, the concave side of the lens can be placed over the basket dome 32, and the basket repivoted into its mast-underlying position as illustrated by another basket 27 in FIGS. 1 and 3. In these positions, the lenses are retained between basket domes and the masts by pads 52 and 53 which are embossed upon the masts. When the lenses and support structure is so arranged, essentially lens-dome point contact and lens-pad point contact is obtained. A lens-edge rim point contact is also provided to completely retain the lens in the desired position.

With the lenses so secured within the holder structure 10, the structure and lenses can be lowered into the cleaning solution contained within the capsule 11. When the retaining lid 12 is secured in place as illustrated in FIG. 2, the entire holder, capsule and lid structure can be placed within a heating element or heat bath to raise the solution and lens temperatures to a sterilizing point. Full contact of sterilizing solution with the lenses is assured, and flow of the solution to and from the lenses is encouraged. After sterilizing, capsule and holders continue to provide a leak-free, useful and attractive lens holder and retaining structure.

The invention is claimed as follows:

1. A holder for contact lenses to be immersed in a sterilizing or cleansing medium, said holder comprising; a capsule; lid means for said capsule; and lens retainer structure, said retainer structure including, a pair of spaced generally parallel elongate mast elements extending in an axial direction and defining an intermediate space therebetween which is free from any obstruction, a pair of open-top basket members pivotly mounted relative to said mast elements and movable both into and out of said intermediate space defined by said mast elements, said basket members being disposed in back-to-back, oppositely facing relation such that the top of each basket member opens toward the adjacent mast element, said basket members being pivotal to or from a first position wherein they are disposed in said intermediate space, with the open top portion thereof aligned with a surface portion of the adjacent mast element, such that said mast element will operate to retain a lens in position within said basket member, and each said basket member being movable to or from a second position, out of alignment with the respective mast member to provide for the initial positioning or removal of a lens element, and each said basket member including a rim, centrally disposed web means defining the bottom portion of said basket member and providing support for the lens to be disposed therein, said web means providing a substantial open area in said bottom portion for the entry of cleansing or sterilizing medium, such that when said basket members are in said first position, said lenses will be maintained within the basket members, with the opposite surfaces of said lenses being exposed to the fluid medium.

2. A holder as defined in claim 1, wherein said web means includes a centrally disposed dome and a plurality of spokes extending radially outward from said dome and connected to said rim.

3. A holder according to claim 1, further including locking means for securing said basket in said first position.

4. A holder as defined in claim 2, wherein said locking means includes a post element on each said basket member, and detent means on each said mast element for releasably receiving said post of the adjacent basket member.

5. A holder according to claim 1, wherein said web means includes a plurality of radially disposed spoke members, with substantial apertures between adjacent spoke members, said apertures providing the open area in said bottom portion of the basket member.

6. A holder according to claim 1, wherein said retainer is integral with said capsule lid.

7. A holder according to claim 1, wherein each said mast element includes an inwardly facing planar surface, which define said surface portion to be aligned with the basket members when in said first position, said planar surface being of sufficient area to insure retention of the lens elements within said basket members.

8. A holder according to claim 1, wherein both said basket members are pivotly mounted to the free end of said mast elements, each said basket member including an elongate hollow pivot structure, with a pin member disposed therein and engaged with each mast element.

9. A holder according to claim 1, wherein said web means includes a dome having a radius of curvature substantially less than that of said lens elements to be disposed therein, so as to minimize the area of contact between said dome and said lens thereby maximizing the amount of surface area of said lens to be exposed to said medium.

10. A holder according to claim 1, wherein said mast elements include inwardly facing pad means for engaging the lens elements to be disposed in said basket members, said pad means having an area substantially less than that of the surface portion thereof overlying said basket members when in said first position, thereby to minimize the area of contact between said mast element and said lens.

11. A holder according to claim 1, wherein said basket members are of identical construction.

* * * * *